US007578721B1

(12) United States Patent
Allmendinger

(10) Patent No.: US 7,578,721 B1
(45) Date of Patent: Aug. 25, 2009

(54) WHEELIE BAR APPARATUS FOR A MODEL VEHICLE

(75) Inventor: Otto Karl Allmendinger, Rowlett, TX (US)

(73) Assignee: Traxxas LP, Plano, TX (US)

( * ) Notice: Subject to any disclaimer, the term of this patent is extended or adjusted under 35 U.S.C. 154(b) by 245 days.

(21) Appl. No.: 11/354,763

(22) Filed: Feb. 15, 2006

(51) Int. Cl.
*A63H 17/26* (2006.01)

(52) U.S. Cl. ..... 446/465; 446/431; 446/470

(58) Field of Classification Search ..... 446/431, 446/440, 462, 465, 470
See application file for complete search history.

(56) References Cited

U.S. PATENT DOCUMENTS

| | | | | |
|---|---|---|---|---|
| 4,773,889 | A | 9/1988 | Rosenwinkel et al. | |
| 4,988,120 | A | 1/1991 | Jones | |
| 5,186,269 | A | 2/1993 | Avakian et al. | |
| D394,003 | S | 5/1998 | Tate | |
| 5,809,755 | A | 9/1998 | Velke et al. | |
| 5,908,345 | A * | 6/1999 | Choi | 446/436 |
| 6,059,055 | A | 5/2000 | Velke et al. | |
| 6,094,897 | A | 8/2000 | Velke et al. | |
| 6,189,304 | B1 | 2/2001 | Velke et al. | |
| 6,327,839 | B1 | 12/2001 | Velke et al. | |
| 6,416,067 | B1 | 7/2002 | Kugler | |
| 6,516,596 | B2 | 2/2003 | Velke et al. | |
| 6,517,092 | B2 | 2/2003 | Humphrey | |
| 6,540,583 | B1 | 4/2003 | Hoeting et al. | |
| 6,688,090 | B2 | 2/2004 | Velke et al. | |
| 6,912,831 | B2 | 7/2005 | Velke et al. | |
| 2001/0014569 | A1 * | 8/2001 | Baker | 446/448 |
| 2003/0024752 | A1 * | 2/2003 | Mayer et al. | 180/220 |
| 2003/0077979 | A1 * | 4/2003 | Hoeting et al. | 446/431 |

OTHER PUBLICATIONS

HPI, "Savage Wheelie Bar" Oct. 19, 2005, web page: www.hpiracing.com/products/en/85245/ HPI Racing, Foothill Ranch, CA, USA.
New Era Models "Wheelie Bar" Dec. 15, 2005, web page: http://www.rchobbies.net/index.php?main_page=product_info &products_id=3415 Nashua, NH, USA.
Tork N Dork, "Wheelie Bar" Sep. 8, 2005, web page: www.torkndork.com/wheeliebar.html Tork n Dork, Quebec, CA.
Traxxas, "ESP Rear Bumper with Wheelie Bar T/E Maxx" Dec. 16, 2005 web page: http://www3.towerhobbies.com/cgi-bin/wti0001p?&I=LXXA00&P=ML Traxxas LP, Plano, TX USA.

(Continued)

*Primary Examiner*—John Ricci
(74) *Attorney, Agent, or Firm*—Carr LLP

(57) ABSTRACT

A wheelie bar assembly for a model vehicle has a mast member having one or fasteners for securing the mast member to a model vehicle, a bearing support member having a length and secured to the mast member for pivotal movement about one or more pivot points, a bearing support member having a length and secured to the mast member for pivotal movement about one or more pivot points, a bearing element secured to or formed on the bearing support member for contacting a surface underlying the vehicle and resisting a wheelie of the vehicle, an adjustment member secured to the mast member for pivotal movement relative to both the mast member and the bearing support member, and the adjustment member being securable to a plurality of different locations along the length of the bearing support member to vary the position of the bearing support member relative to the mast member and a surface underlying the vehicle.

25 Claims, 6 Drawing Sheets

OTHER PUBLICATIONS

Traxxas, "Ultimate Maxx Wheelie Bar", Dec. 16, 2005, web page: http://www.rlhobbies.com/cart/prod_detail.php?prodid=PCI0100 Traxxas LP, Plano, TX, USA.

Trinity, "Wheelie Bar Set T/E Maxx", Dec. 16, 2005, web page: http://www3.towerhobbies.com/cgi-bin/wti0001p?&I=LXZH42 &P=7 Trinity, Piscataway, NJ, USA.

Unknown, Wheelie Bar Apparatus, Dec. 16, 2005, web page: www.RLhobbies.com 2 photographs (admitted prior art).

Unknown, Wheelie Bar Apparatus, Dec. 16, 2005, web page: www.RLhobbies.com 1 photograph (admitted prior art).

Unknown, Wheelie Bar Apparatus, Sep. 8, 2005, 3 photographs (admitted prior art).

Unknown, Wheelie Bar Apparatus, Sep. 8, 2005, 1 photograph (admitted prior art).

* cited by examiner

WHEELIE BAR APPARATUS FOR A MODEL VEHICLE

FIELD OF THE INVENTION

The present invention relates to vehicle design and, more particularly, to vehicle performance and attachment of vehicle accessories.

BACKGROUND OF THE INVENTION

A "wheelie" is a maneuver or action in which acceleration or braking causes a wheeled vehicle to rotate about either the rear or front drive axle to lift the axle and wheel (or wheels) at the other end of the vehicle, above the ground. Motorized vehicles rely upon throttle and brake control to control the extent and duration of a wheelie. Vehicles can travel for some distance in a wheelie position and, in extreme cases, also be made to flip over if the wheelie is executed with too much engine or braking power, or too little control.

A "wheelie bar" is typically used at the rear of a vehicle to limit the amount of rotation about the rear axle and prevent the vehicle from flipping over. A wheelie bar can also be used to limit the amount of rotation about the front axle and prevent the vehicle from flipping over in a forward direction. Generally, a wheelie bar is designed to place a bearing element at a certain distance above a surface underlying a vehicle at rest, and limits the possible rotation of the vehicle, depending on the height of the bearing element above the surface underlying the vehicle. Unfortunately, conventional wheelie bars generally require tools and separate mechanical fasteners to install or remove the wheelie bar, and to adjust the position of adjustable wheelie bars.

Accordingly, there is a need for a wheelie bar that can be more easily installed and removed.

SUMMARY OF THE INVENTION

These and other objects and advantages are achieved in accordance with an embodiment of the present invention, wherein a wheelie bar is configured to be secured to and removed from a vehicle by coupling to existing structure of the vehicle. In another aspect of the invention, the wheelie bar is adjustable by repositioning at least a portion of one or more support members connecting to the wheelie bar.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
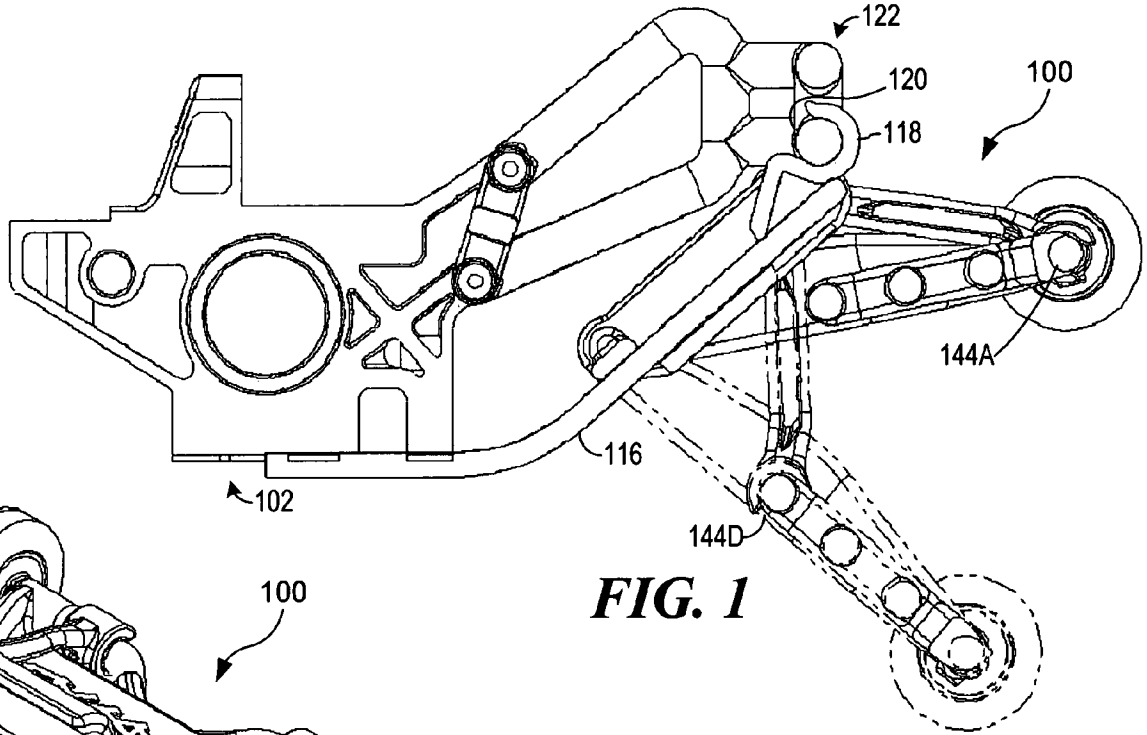
FIG. 1 is a side elevation of a portion of a model vehicle chassis and wheelie bar vehicle extension.

FIG. 1 illustrates a vehicle extension 100 supported on a chassis 102 of a model vehicle. The vehicle extension 100 can be a wheelie bar as shown, or some other apparatus such as a mounting platform, a trailer hitch, or the like. The vehicle extension can be installed and removed without the use of separate fasteners or tools.

Figure 2:
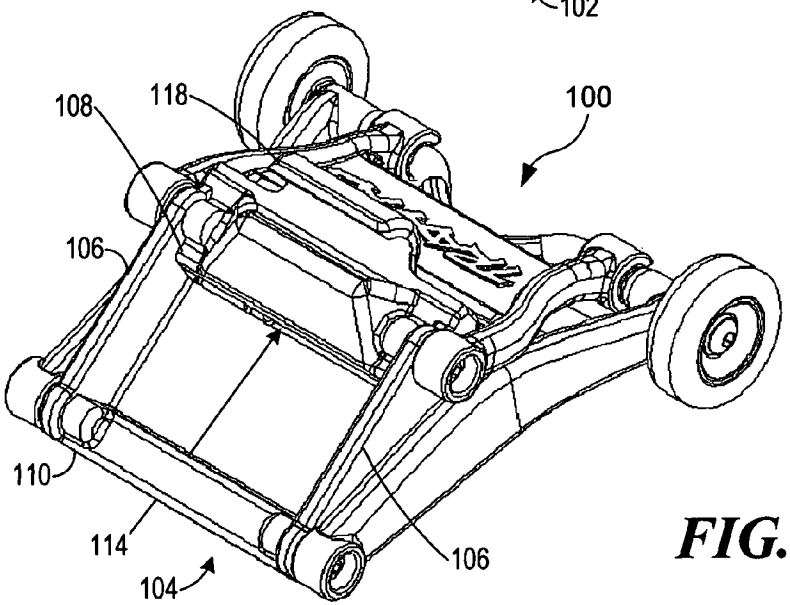
FIG. 2 is a perspective view of a wheelie bar vehicle extension.
Figure 3:
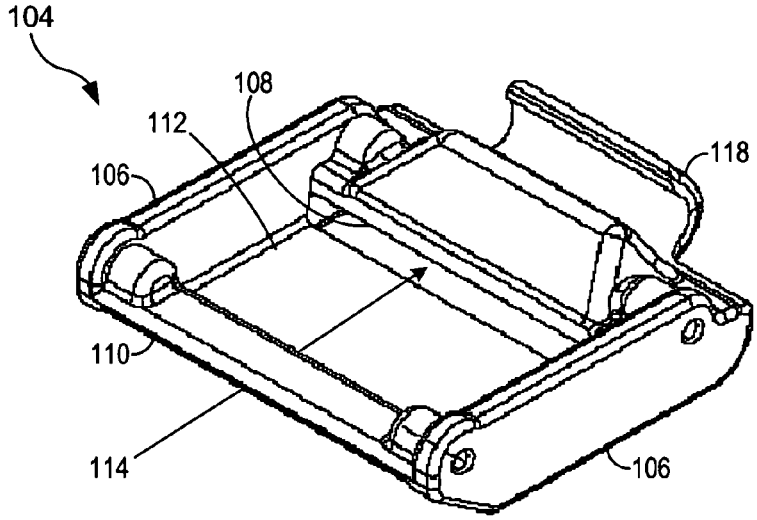
FIG. 3 is a perspective view of a frame portion of a vehicle extension.

Turning now to FIGS. 2-3, in an embodiment, the vehicle extension 100 comprises a mast member configured as a frame 104 having spaced-apart longitudinal structural members or rails 106 interconnected by spaced-apart lateral structural members 108, 110, 112. At least one lateral structural member 108 is spaced vertically from at least one other lateral structural member 112, thereby forming a slot or receptacle 114 for receiving a structural feature of the chassis of the model vehicle. It will be apparent that the mast member can be configured variously, such as one or more poles or rods, and in various other shapes that provide support to the vehicle extension.

Figure 15:
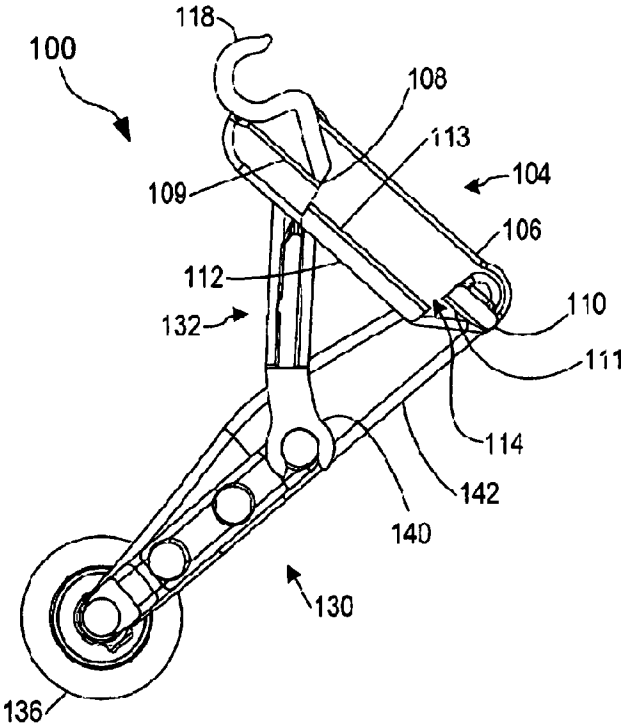
FIG. 15 is a side elevation cut-away view of wheelie bar vehicle extension taken along the lines 15-15 in FIG. 9.
Figure 14C:
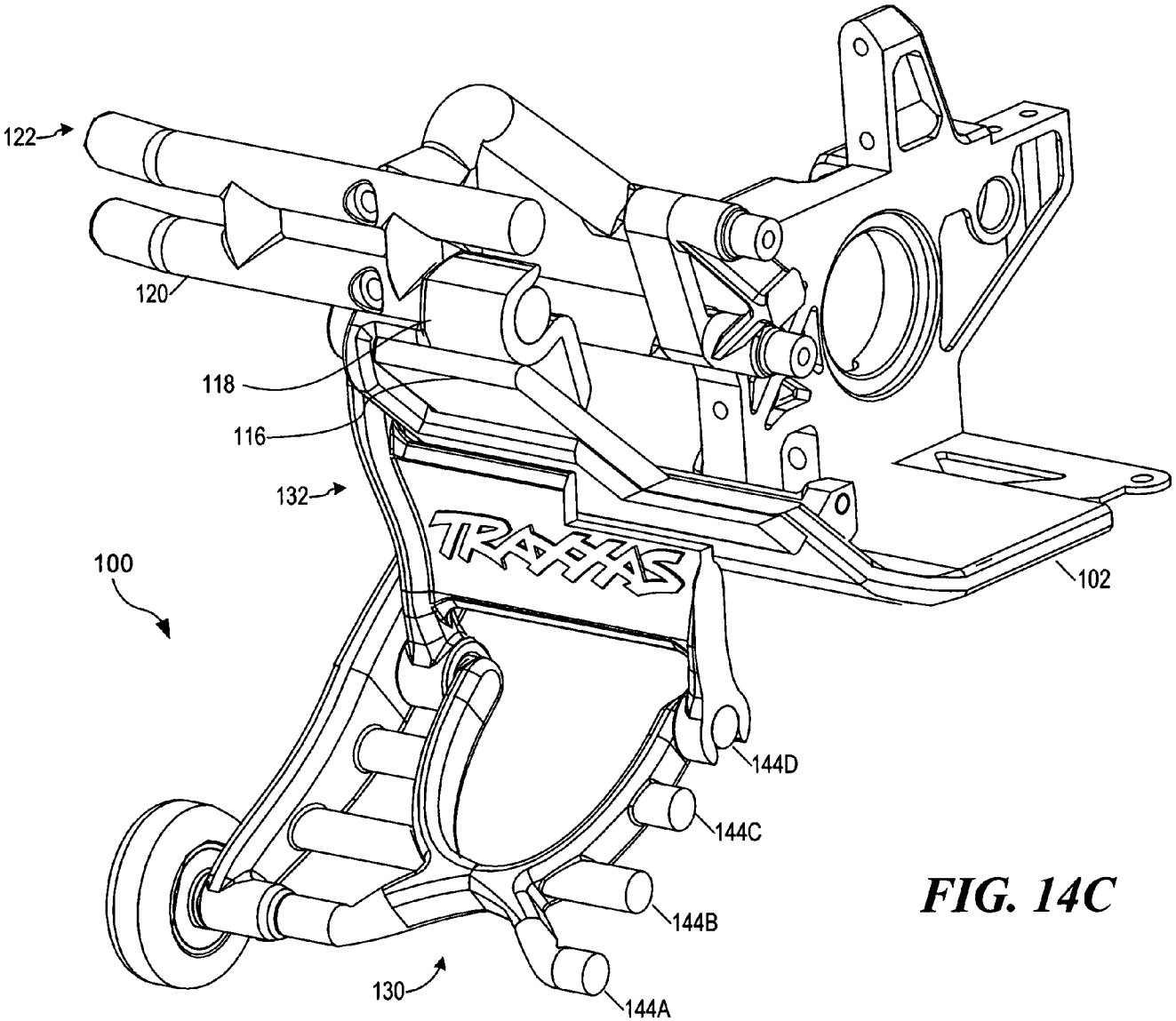
FIG. 14 C is a side elevation cut-away view of a model vehicle chassis and wheelie bar vehicle extension taken along the lines 14-14 in FIG. 13.

Turning now to FIG. 15, a first lateral structural member 108 has at least one surface 109 that is substantially co-planar with a surface 111 of a second lateral structural member 110, and a third lateral structural member 112 has a surface 113 disposed in a separate plane substantially parallel with the plane of the first and second lateral structural members 108, 110. The vehicle extension 100 can be coupled to the chassis of the model vehicle by sliding the frame 104 over a suitable structural feature of the chassis, such as skid plate 116, such that the skid plate 116 slides into the slot 114 formed between the spaced-apart lateral structural members 108, 110, 112 of the mast member 104 of the vehicle extension 100. In an embodiment, the skid plate 116 can be a resilient structural member that can be bent slightly downward to allow the vehicle extension to slide onto it, after which the skid plate 116 returns to its normal position urging the installed vehicle extension 100 upward and inward, coming to rest against other structural features of the chassis, such as against a bumper 122.

The vehicle extension 100 further comprises one or more fasteners 118 for securing the vehicle extension to the chassis. In the embodiment shown in FIGS. 1-2 and FIGS. 10-13, a clip 118 formed integrally with the first lateral structural member 108 engages a bumper 122 of the vehicle to secure the vehicle extension 100 to the vehicle. As the vehicle extension 100 slides down over the skid plate 116, the clip 118 snaps over a tube 120 of vehicle bumper 122 to engage the bumper 122. In an embodiment, the clip 118 engages the vehicle bumper 122 securely and is further secured against the bumper 122 by spring action of the resilient skid plate 116. Removal of the vehicle extension 100 is accomplished by pulling the vehicle extension 100 away from the bumper 122 until the clip 118 releases the bumper 122, and sliding the vehicle extension 100 off the skid plate 116.

Turning now to FIGS. 6-9, an embodiment of the vehicle extension 100 can be a wheelie bar used for controlling the extent of vehicle wheelies by contacting a surface underlying the vehicle and resisting the wheelie of the vehicle. It is desirable to be able to vary the height of the wheelie bar 100 to limit the extent of vehicle rotation about an axle during a wheelie. The wheelie bar apparatus 100 as shown provides two or more adjustable height positions. The lowest height position offers the most restrictive control of wheelies and limits rotation of the vehicle to only a few degrees. The highest height position offers the least restrictive control of wheelies and permits the greatest degree of vehicle rotation.

The wheelie bar apparatus shown in FIGS. 6-9 comprises the mast member, for example frame 104 as described above, a bearing support member 130 and an adjustment member 132. As an alternative to the frame 104 described above, a mast member can be one structural member of any configuration that attaches to the vehicle and supports the bearing support member 130. The bearing support member 130 is secured at a proximal end to the mast member 104 for pivotal movement about pivot points 134. A bearing element 136 can be secured to or formed on the bearing support member 130 for contacting a surface underlying the vehicle during a wheelie. The bearing element 136 can be a wheel as shown, or a skid, a runner, a metal plate, a roller, or the like. The adjustment member 132 is secured at a proximal end to the mast member 104 for pivotal movement about pivot points 138, relative to both the mast member 104 and the bearing support member 130. One or more fasteners 140 provided at a distal end of the adjustment member 132 can be used to secure the adjustment member 132 to a selected position on the bearing support member 130. The mast member 104, the bearing support member 130, and the adjustment member 132 can form a triangle of variable configuration for adjusting the height of the bearing element 136 above the surface underlying the vehicle. In the embodiment shown, the configuration of the triangle varied by adjusting the adjustment arm 132 to change the length of one side of the triangle formed by the mast member 104, wheelie bar 130 and adjustment arm 132.

The bearing support element 130 can be configured as a lower arm assembly as shown, having first and second longitudinal rails 142 having two or more lateral crossbars 144 disposed therebetween.

Figure 4:
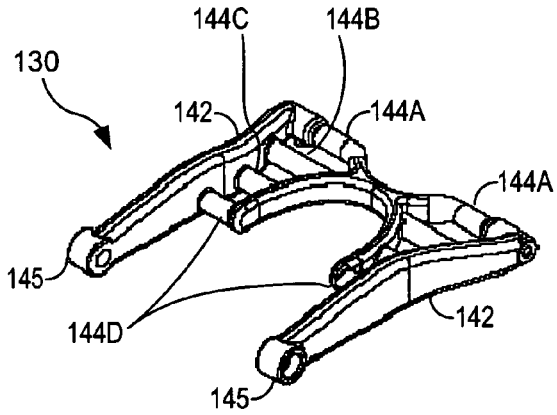
FIG. 4 is a perspective view of a bearing support member portion of a wheelie bar vehicle extension.

Referring now to FIG. 4 and to FIGS. 6-9, the first and second longitudinal rails 142 each support a journal 145 at a proximal end thereof for connecting to pivot points 134 at mast member 104. The rails 142 each curve outward, away from each other, towards the distal ends thereof, at which bearing elements 136 are supported. This outward curvature provides sufficient lateral separation, or wide-track, between the bearing elements 136 for stability while also reducing the lateral distance between the pivot points 134 at which the bearing support elements 136 are secured to the mast member 104. The bearing support element 130 has a u-shaped reinforcing portion 147 interconnecting top crossbars 144D and intermediate crossbars 144B-144C such that the crossbars 144 need not span the entire distance between the rails 142 but structural support for the rails 142 and crossbars 144 is still provided. The bearing support member 130 can be formed all in one piece. Alternatively, the bearing support member can be constructed of several pieces secured together by fasteners or by welding or the like.

Figure 5:
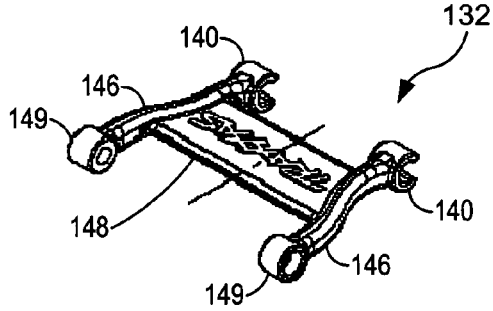
FIG. 5 is a perspective view of an adjustment member portion of a wheelie bar vehicle extension.
Figure 6:
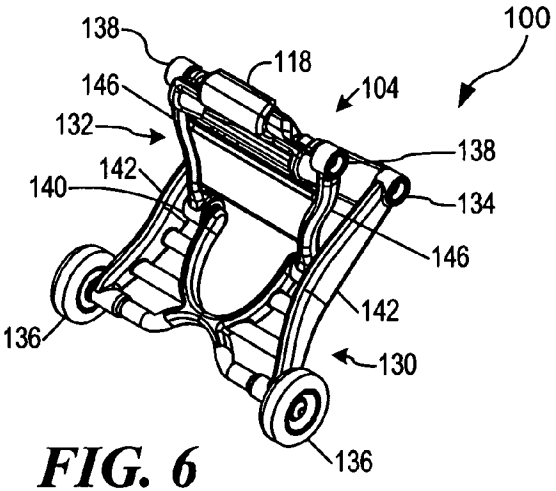
FIG. 6 is a perspective view of a wheelie bar vehicle extension.
Figure 7:
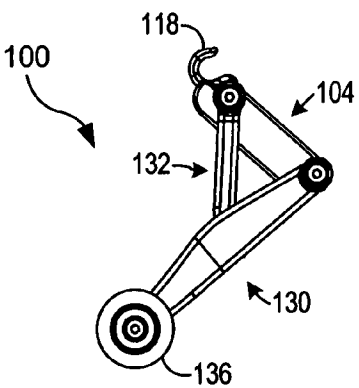
FIG. 7 is a side elevation of a wheelie bar vehicle extension.
Figure 8:
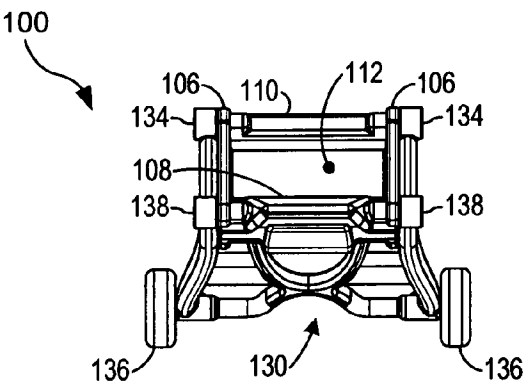
FIG. 8 is a top plan view of a wheelie bar vehicle extension.
Figure 9:
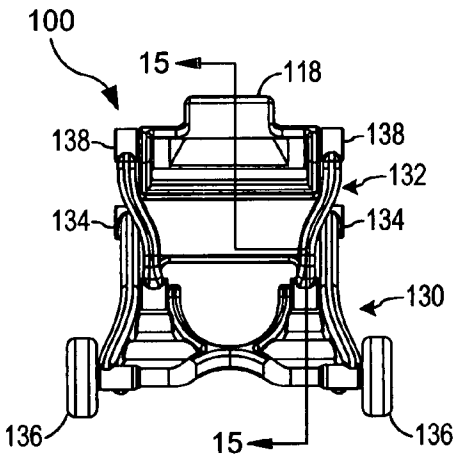
FIG. 9 is a rear elevation of a wheelie bar vehicle extension.
Figure 10:
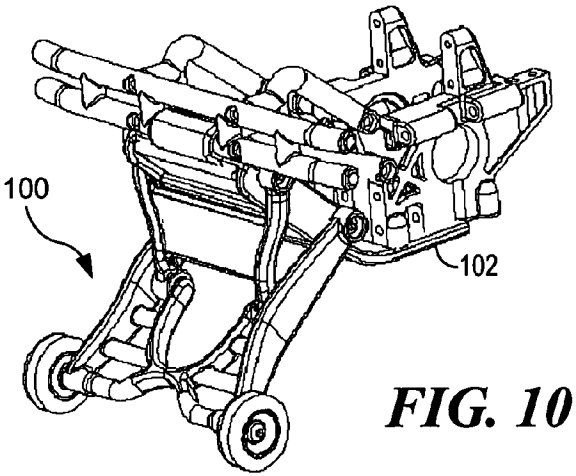
FIG. 10 is perspective view of a portion of a model vehicle chassis and wheelie bar vehicle extension.
Figure 11:
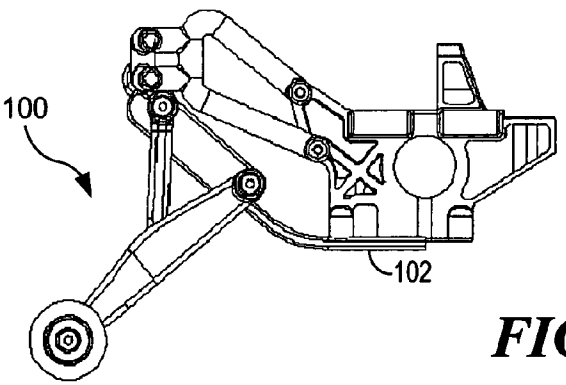
FIG. 11 is a side elevation of a model vehicle chassis and wheelie bar vehicle extension.
Figure 12:
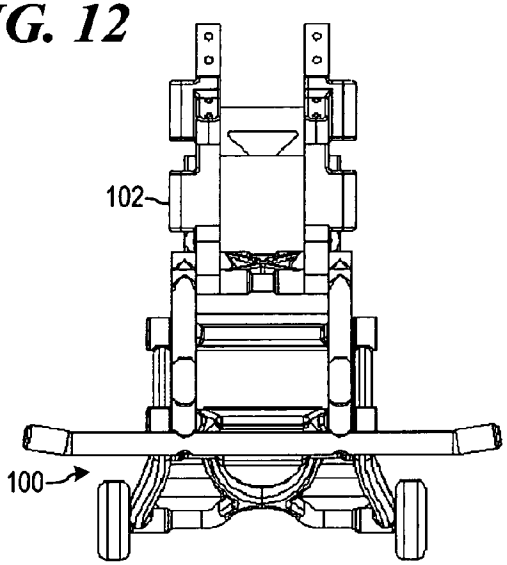
FIG. 12 is a top plan view of a model vehicle chassis and wheelie bar vehicle extension.
Figure 13:
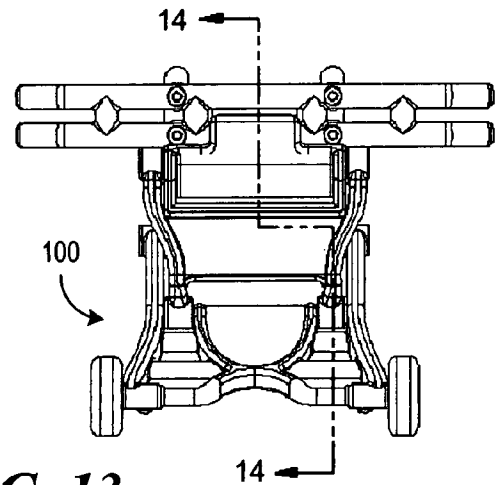
FIG. 13 is a rear elevation of a model vehicle chassis and wheelie bar vehicle extension.

The adjustment member 132 can be configured as an upper arm assembly as shown, having first and second adjustment arms 146 having at least one lateral structural member 148 disposed there-between. Referring now to FIG. 5, and to FIGS. 6-9, the first and second adjustment arms 146 each support a journal 149 at a proximal end thereof for connecting to pivot points 138 at mast member 104. The arms 146 each curve inward, towards each other, towards the distal ends thereof, at which fasteners 140 are formed. This inward curvature of adjustment arms 146 positions the fasteners 140 inside the rails 142 of bearing support member 130 and in alignment with a selected crossbar 144A-D, while maintaining a lateral separation between the journals 149 approximately equal to a lateral separation of journals 145 on the bearing support member 130. The lateral structural member 148 interconnects adjustment arms 146 and can take the form of a generally-rectangular plate as shown, which makes a convenient place to display a logo or other symbol or information. Alternatively, another reinforcing structure can be provided such as two or more lateral crossbars, an X-shaped structure, a structural lattice, or the like. The adjustment member 132 can be formed all in one piece. Alternatively, the adjustment member can be constructed of several pieces secured together by fasteners or by welding or the like.

The fasteners 140 at the distal ends of the adjustment member 132 can be configured as clips for releaseably engaging a selected crossbar 144A-D. The height of the bearing element 136 can be adjusted by releasing the clips 140 from a crossbar 144A-D and engaging the clips 140 to a different crossbar 144A-D. The clips, or clamps, retainers and the like, can be fastened and released manually without the use of tools.

Figure 14B:
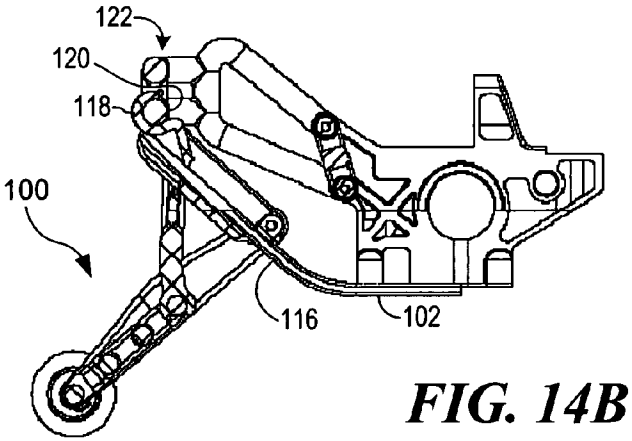
FIG. 14B is a side elevation cut-away view of a model vehicle chassis and wheelie bar vehicle extension taken along the lines 14-14 in FIG. 13.
Figure 14A:
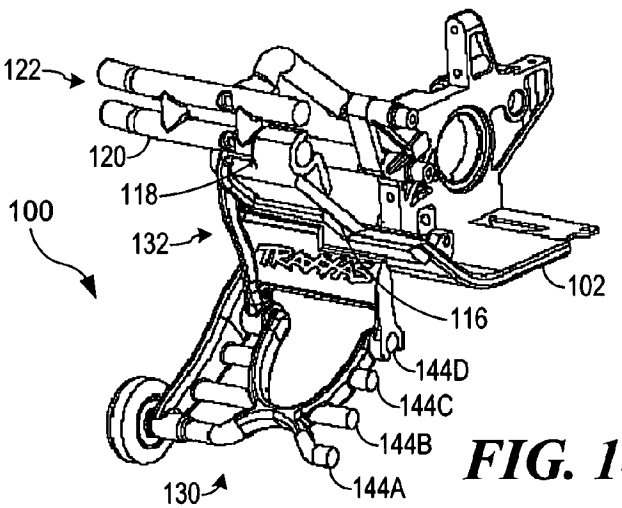
FIG. 14A is a perspective cut-away view of a model vehicle chassis and wheelie bar vehicle extension taken along the lines 14-14 in FIG. 13.

Referring now to FIG. 14A, the clips 140 can engage the bottom crossbar 144A to provide the highest height of the bearing elements, as illustrate by the solid lines in FIG. 1. The clips 140 can engage the top crossbar 144D to provide the lowest height of the bearing elements, as illustrated by the broken lines in FIG. 1. The clips 140 can engage an intermediate crossbar 144B-C to provide intermediate height of the bearing elements 136. The height of the bearing elements 136, and the resultant performance of the wheelie bar 100, can be adjusted by disengaging the clips 140 of the adjustment member 132 from a crossbar 144 of the bearing support member 130, reconfiguring the geometry of the triangular wheelie bar apparatus 100, and engaging the clips 140 on a different crossbar 144. Reconfiguring the geometry of the wheelie bar apparatus 100 can be performed without tools and can be performed with the wheelie bar apparatus 100 installed on the vehicle or with the wheelie bar apparatus 100 removed from the vehicle.

It will be apparent to those skilled in the art that, although the crossbars 144 are shown on the lower, bearing support member 130 and the clips 140 engaging the crossbar 144 are shown on the upper, adjustment member 132, the apparatus 100 can be designed to have crossbars 144 on the upper, adjustment member 132 and clips 140 engaging the crossbars 144 on the lower bearing support member 130. The adjustment member 132 is nevertheless securable to a plurality of different locations along the length of the bearing support member 130 to vary the position of the bearing support member 130 relative to the mast member 104 and a surface underlying the vehicle.

Alternative configurations of the wheelie bar vehicle extension 100 described herein can utilize a rod positioned along the centerline of the vehicle as the structural feature for supporting the wheelie bar vehicle extension. One or more sleeves provided on the vehicle extension assembly can be configured to receive the rod. Two or more such rods can be provided on the vehicle chassis, and may be utilized to provide a skid-plate function of deflecting the vehicle from underlying hazards, as well as mounting a wheelie bar vehicle extension 100 as hereinbefore described. Two or more sleeves on the wheelie bar vehicle extension 100 can be provided to receive the two or more rods.

In another alternative configuration, the mast member 104 that supports the bearing support member can be mounted to one or more bumper members or span between two vertically spaced bumpers, using one or more clips similar to clip 118 as shown and described hereinbefore. In another alternative configuration, the bearing support member 130 can be fixed in-place, secured to the mast member 104, and can also be braced by a third support member that is non-adjustable. In another alternative, the wheelie bar vehicle extension 100 can be used mounted to the front of a four-wheel-drive vehicle to limit the extent of wheelies performed in reverse.

In further alternative configurations, the mast member 104 can be secured to the vehicle chassis in a substantially vertical orientation, or in a substantially horizontal orientation, or in some intermediate orientation as shown and described hereinbefore.

In further alternative configurations, the attachment point of the adjustment member 132 can be continuously variable along some length of the bearing support member 130 using, for example, a journal on the adjustment member 132 that engages a slot on the bearing support member 130. The adjustment member 132 can be tightened with a screw or other suitable fastener to secure the adjustment member 132 in the desired location.

In another alternative configuration, the wheelie bar vehicle extension assembly, with or without an adjustable arm, can be secured directly to the vehicle, without use of a mast member. For example, clips can be formed on the ends of the wheelie bar and another support member, which would then be secured to a mast formed on the vehicle itself, or directly to a pair of bumpers and the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A wheelie bar assembly for a model vehicle, comprising:

a mast member having one or more fasteners for securing the mast member to a model vehicle;

a bearing support member having a length and secured to the mast member for pivotal movement about one or more pivot points;

a bearing element secured to or formed on the bearing support member for contacting a surface underlying the vehicle and resisting a wheelie of the vehicle;

an adjustment member secured to the mast member for pivotal movement relative to both the mast member and the bearing support member; and wherein the adjustment member is securable to a plurality of different locations along the length of the bearing support member to vary the position of the bearing support member relative to the mast member and a surface underlying the vehicle.

2. The wheelie bar assembly of claim 1, wherein:

the mast member has an upper end and a lower end relative to the vehicle; and the adjustment member pivots about a point closer to the upper end of the mast member than at least one of the one or more pivot points of the bearing support member.

3. The wheelie bar assembly of claim 1, wherein the one or more fasteners of the mast member comprise one or more clips for engaging and releasing from the vehicle.

4. The wheelie bar assembly of claim 3, wherein the one or more clips are configured to engage and release from a bumper of the vehicle.

5. The wheelie bar assembly of claim 1, wherein the one or more fasteners comprise one or more couplings configured to engage and release from the vehicle.

6. The wheelie bar assembly of claim 1, further comprising one or more sleeve members secured to the mast member, wherein the one or more sleeve members are configured to receive at least a portion of a skid plate of the vehicle.

7. The wheelie bar assembly of claim 1, wherein the bearing element comprises one of a group consisting of a wheel, skid, runner or metal plate.

8. A model vehicle wheelie bar assembly, comprising:

a vehicle extension comprising one or more support members configured to restrict a vehicle wheelie;

one or more releasable fasteners configured to releasably secure the vehicle extension to a vehicle, the one or more releasable fasteners resisting release of the vehicle extension from the vehicle until a substantially linear releasing force is applied to the vehicle extension exceeding a threshold amount of the releasing force, the one or more releasable fasteners releasing at least a portion of the vehicle extension from the vehicle when the threshold releasing force amount is exceeded; and wherein the threshold substantially linear releasing force is in a direction other than the direction of the force applied to the vehicle extension by a surface underlying the vehicle extension when the vehicle extension restricts a vehicle wheelie.

9. The wheelie bar assembly of claim 8, wherein the vehicle extension is configured to be adjusted independently of the one or more fasteners to vary the position relative to an underlying surface at which a vehicle wheelie is restricted by the one or more support members.

10. The wheelie bar assembly of claim 8, wherein the one or more fasteners comprise one or more clips for engaging and releasing from the vehicle.

11. The wheelie bar assembly of claim 10, wherein the one or more clips are configured to engage and release from a bumper of the vehicle.

12. The wheelie bar assembly of claim 8, wherein the one or more fasteners comprise one or more couplings configured to engage and release from the vehicle.

13. The wheelie bar assembly of claim 8, further comprising one or more sleeve members secured to the vehicle extension, wherein the one or more sleeve members are configured to receive at least a portion of a skid plate of the vehicle.

14. The wheelie bar assembly of claim 8, wherein the bearing element comprises one of a group consisting of a wheel, skid, runner or metal plate.

15. The model vehicle wheelie bar assembly of claim 8, wherein the one or more releasable fasteners configured to releasably secure the vehicle extension to a vehicle comprise one or more clips.

16. The model vehicle wheelie bar assembly of claim 8, wherein the one or more releasable fasteners comprise a displaceable retention member applying a spring force to secure the vehicle extension to the vehicle, the displaceable retention member being displaced against the spring force to release at least a portion of the vehicle extension in response to application of the releasing force.

17. The model vehicle wheelie bar assembly of claim 8, wherein the releasing force is applicable by a human hand directly to the vehicle extension.

18. A wheelie bar assembly for a model vehicle, comprising:

a mast member having one or more fasteners for securing the mast member to a model vehicle without use of additional hardware or components;

a bearing support member having a length and secured to the mast member for pivotal movement about one or more pivot points;

a bearing element secured to or formed on the bearing support member for contacting a surface underlying the vehicle and resisting a wheelie of the vehicle;

an adjustment member secured to the mast member for pivotal movement relative to both the mast member and the bearing support member; and wherein the adjustment member is securable to a plurality of different locations along the length of the bearing support member to vary the position of the bearing support member relative to the mast member and a surface underlying the vehicle; and wherein the adjustment member is configured to be adjusted independently of the one or more fasteners to vary the position relative to an underlying surface at which a vehicle wheelie is restricted by the bearing support member.

19. The wheelie bar assembly of claim 18, wherein:

the mast member has an upper end and a lower end relative to the vehicle; and the adjustment member pivots about a point closer to the upper end of the mast member than at least one of the one or more pivot points of the bearing support member.

20. The wheelie bar assembly of claim 18, wherein the one or more fasteners of the mast member comprise one or more clips for engaging and releasing from the vehicle.

21. The wheelie bar assembly of claim 20, wherein the one or more clips are configured to engage and release from a bumper of the vehicle.

22. The wheelie bar assembly of claim 18, wherein the one or more fasteners comprise one or more couplings configured to engage and release from the vehicle.

23. The wheelie bar assembly of claim 18, further comprising one or more sleeve members secured to the mast member, wherein the one or more sleeve members are configured to receive at least a portion of a skid plate of the vehicle.

24. The wheelie bar assembly of claim 18, wherein the bearing element comprises one of a group consisting of a wheel, skid, runner or metal plate.

25. A wheelie bar for a model vehicle, comprising:

a frame for connecting to a chassis extension of a model vehicle, the frame having a slot for receiving the chassis extension and a clip for engaging a portion of a bumper of a model vehicle;

a lower arm assembly pivotably coupled to the frame, having a plurality of crossbars laterally disposed between two main lower arms;

at least one wheel rotatably coupled to a distal end of the frame;

an upper arm assembly pivotably coupled to the frame, having at least one cross member laterally disposed between two main upper arms, the two upper arms having a clip at the distal ends thereof;

wherein the upper arm clips engage a selected crossbar of the lower arm assembly, and wherein the at least one wheel is adjustable in height above a surface underlying the vehicle in dependence upon which cross bar is selected.

* * * * *

UNITED STATES PATENT AND TRADEMARK OFFICE

CERTIFICATE OF CORRECTION

PATENT NO. : 7,578,721 B1
APPLICATION NO. : 11/354763
DATED : August 25, 2009
INVENTOR(S) : Otto Karl Allmendinger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 283 days.

Signed and Sealed this

Seventh Day of September, 2010

David J. Kappos

David J. Kappos
*Director of the United States Patent and Trademark Office*